US010107017B2

(12) United States Patent
An et al.

(10) Patent No.: US 10,107,017 B2
(45) Date of Patent: Oct. 23, 2018

(54) INSIDE DOOR HANDLE ASSEMBLY FOR VEHICLE

(71) Applicants: Hue Yeon An, Chungcheongnam-Do (KR); Jae In Yu, Chungcheongnam-Do (KR); Hang Chul Ko, Chungcheongnam-Do (KR); Jae Won Lee, Chungcheongnam-Do (KR); Sung Ik Cho, Chungcheongnam-Do (KR)

(72) Inventors: Hue Yeon An, Chungcheongnam-Do (KR); Jae In Yu, Chungcheongnam-Do (KR); Hang Chul Ko, Chungcheongnam-Do (KR); Jae Won Lee, Chungcheongnam-Do (KR); Sung Ik Cho, Chungcheongnam-Do (KR)

(73) Assignee: SEOYON E-HWA CO., LTD. (KR)

( * ) Notice: Subject to any disclaimer, the term of this patent is extended or adjusted under 35 U.S.C. 154(b) by 282 days.

(21) Appl. No.: 15/019,251

(22) Filed: Feb. 9, 2016

(65) Prior Publication Data

US 2016/0230428 A1 Aug. 11, 2016

(30) Foreign Application Priority Data

Feb. 9, 2015 (KR) ..... 10 2015 0019557

(51) Int. Cl.
*E05B 85/10* (2014.01)
*E05B 85/12* (2014.01)
*E05B 79/06* (2014.01)

(52) U.S. Cl.
CPC ..... *E05B 85/12* (2013.01); *E05B 79/06* (2013.01)

(58) Field of Classification Search
CPC ... Y10T 292/57; Y10T 292/82; Y10T 16/458; Y10T 292/85; Y10T 74/20732;
(Continued)

(56) References Cited

U.S. PATENT DOCUMENTS 5,101,597 A * 4/1992 Pelachyk ..... E05B 79/06 16/DIG. 24
5,183,302 A * 2/1993 Pelachyk ..... E05B 85/12 292/336.3

(Continued)

FOREIGN PATENT DOCUMENTS

JP 2000-087600 A 3/2000
KR 10-2011-0023202 A 3/2011
KR 10-2012-0008759 A 2/2012

OTHER PUBLICATIONS

Korean Office Action for Application No. 9-5-2016-024032060 dated Mar. 31, 2016.

*Primary Examiner* — Mark A Williams
(74) *Attorney, Agent, or Firm* — Tarolli, Sundheim, Covell & Tummino LLP

(57) ABSTRACT

Disclosed herein is an inside door handle assembly in a vehicle may include: a handle bracket in which a lever of the inside door handle is rotatably installed and a hook coupling hole is formed; a coupling protrusion protruding from the handle bracket; a mounting plate protruding from a door module, having a coupling groove into which the coupling protrusion is inserted in a direction parallel to a door, and having a locking bump to support the coupling protrusion such that the coupling protrusion is not moved in a direction crossing the door in a state where the coupling protrusion is inserted into the coupling groove; and a hook formed integrally with the door module so as to protrude from the door module, and inserted and coupled to the hook coupling hole of the handle bracket.

3 Claims, 8 Drawing Sheets

(58) Field of Classification Search
CPC ..... Y10S 292/53; Y10S 16/24; E05B 85/12; E05B 79/06; E05B 85/13; E05B 15/1635; E05B 85/02
USPC ..... 292/336.3
See application file for complete search history.

(56) References Cited

U.S. PATENT DOCUMENTS 5,282,657 A * 2/1994 Clinch ..... E05B 85/12 292/336.3
6,052,948 A * 4/2000 Spitzley ..... E05B 79/06 49/460
7,441,374 B2 * 10/2008 Syed ..... B60J 5/0416 292/352

* cited by examiner

Fig. 1 – Prior Art

Fig. 2 – Prior Art

INSIDE DOOR HANDLE ASSEMBLY FOR VEHICLE

This application claims priority of Korean. Patent Application Serial No. 10-2015-0019557, filed 9 Feb. 2015, which is incorporated herein in its entirety.

BACKGROUND OF THE INVENTION

Field of the Invention

Exemplary embodiments of the present invention relate to an inside door handle assembly for a vehicle, and more particularly, an inside door handle assembly for a vehicle, which couples an inside handle assembly to a door module of a vehicle.

Description of the Related Art

In general, a door of a vehicle has a door handle which is controlled by a user's hand to open the door.

The door includes an outside door handle and an inside door handle. The outside door handle enables a user to open the door from outside such that the user can get in the vehicle, and the inside door handle enables a user to open the door from inside such that the user can get off the vehicle.

Referring to FIG. 1, a lever 1 of the inside door handle is rotatably hinge-coupled to a handle bracket 4 and exposed to the inside through a handle housing 2 such that a user can control the lever 1 in the vehicle (refer to Korean Patent Laid-Open Publication No. 10-2010-0064574).

As illustrated in FIG. 2, the handle bracket 4, to which the lever 1 of the inside door handle is coupled, must be reliably assembled, because the handle bracket 4 is a part of the door. For this structure, the handle bracket 4 is screw-coupled at a minimum of 3 to 5 positions.

When the screw coupling method is used, the robustness is improved, but the assembling efficiency is degraded. Furthermore, the screw coupling method goes against the recent trend that the use of screws is minimized to modularize parts forming a door.

SUMMARY OF THE INVENTION

The present invention has been made in view of the above problems, and it is an object of the present invention to provide an inside door handle assembly for a vehicle, in which a handle bracket coupled to which an inside handle lever of a door is coupled is fixed and coupled to a handle housing, such that a module of an inside door handle can be conveniently and reliably assembled.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, an inside door handle assembly in a vehicle may include: a handle bracket in which a lever of the inside door handle is rotatably installed and a hook coupling hole is formed; a coupling protrusion protruding from the handle bracket; a mounting plate protruding from a door module, having a coupling groove into which the coupling protrusion is inserted in a direction parallel to a door, and having a locking bump to support the coupling protrusion such that the coupling protrusion is not moved in a direction crossing the door in a state where the coupling protrusion is inserted into the coupling groove; and a hook formed integrally with the door module so as to protrude from the door module, and inserted and coupled to the hook coupling hole of the handle bracket.

The coupling groove of the mounting plate may have an opening formed at the front of the door such that the coupling bracket is not moved in the vertical direction of the door.

The coupling protrusion may include a hinge groove for housing the locking bump.

The door module may have a coupling boss piece-coupled to a door panel, and the handle bracket may have a piece coupling hole formed at one side thereof such that the coupling boss is passed through the piece coupling hole.

The door module may include: a door trim; and a handle housing having a lever housing groove for housing the handle lever, and fixed and coupled to the door trim.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Hereafter, embodiments of the present invention will be described with reference to the accompanying drawings.

Figure 1:
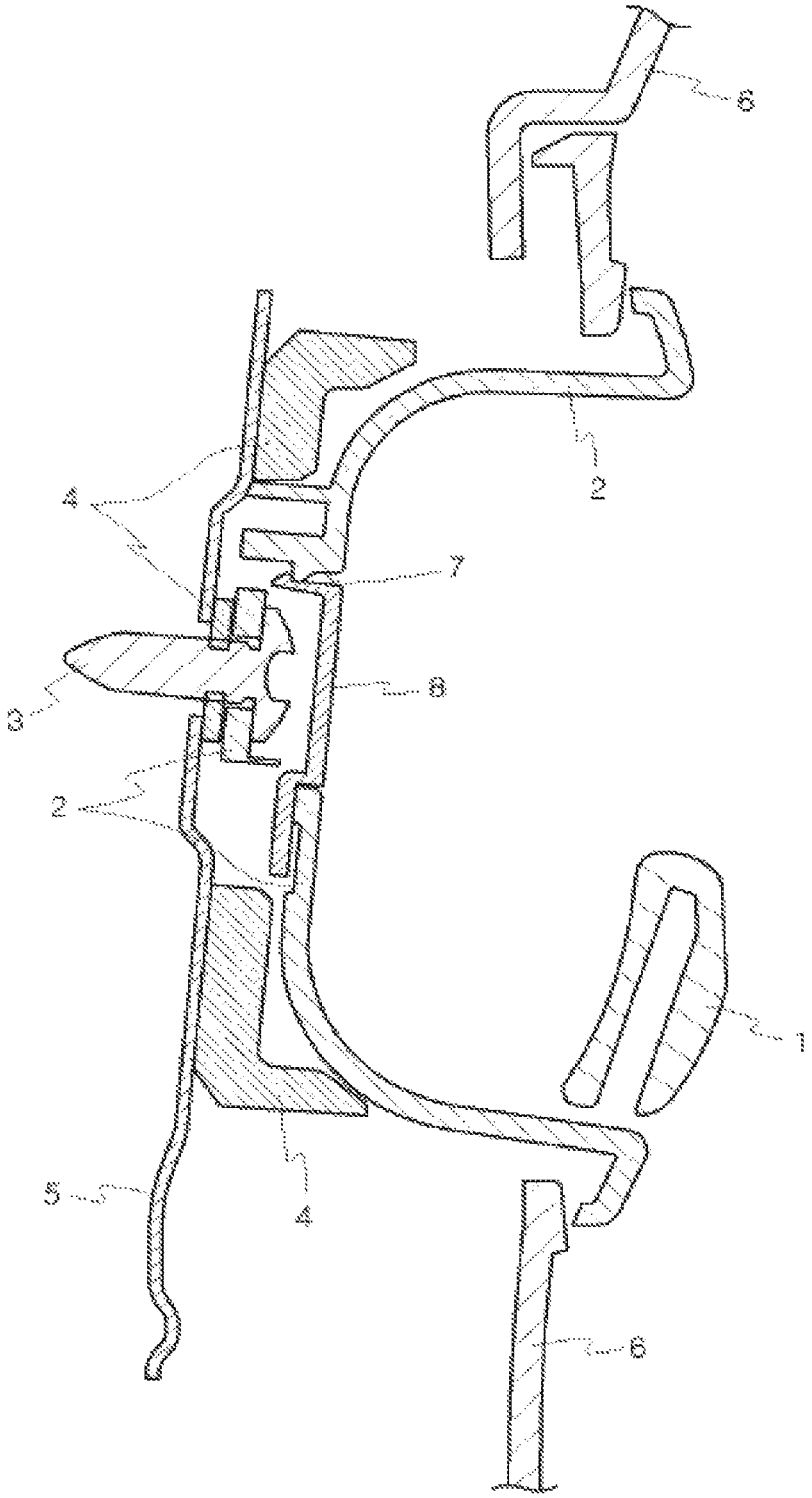
FIG. 1 is a side view of an inside door handle assembly for a vehicle according to the related art.
Figure 2:
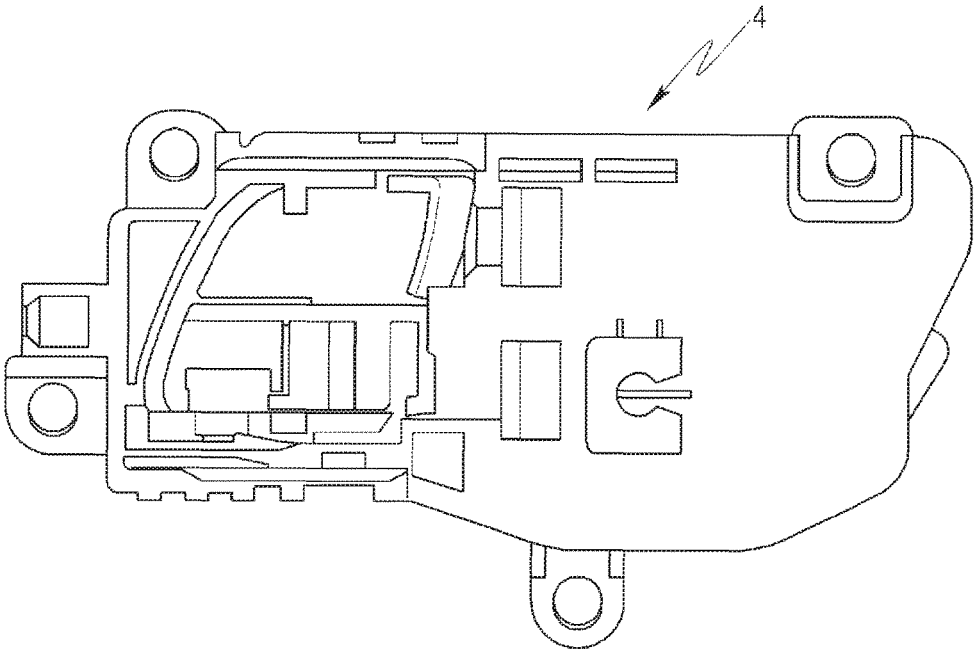
FIG. 2 is a perspective view of a handle bracket of the inside door handle assembly according to the related art.
Figure 3:
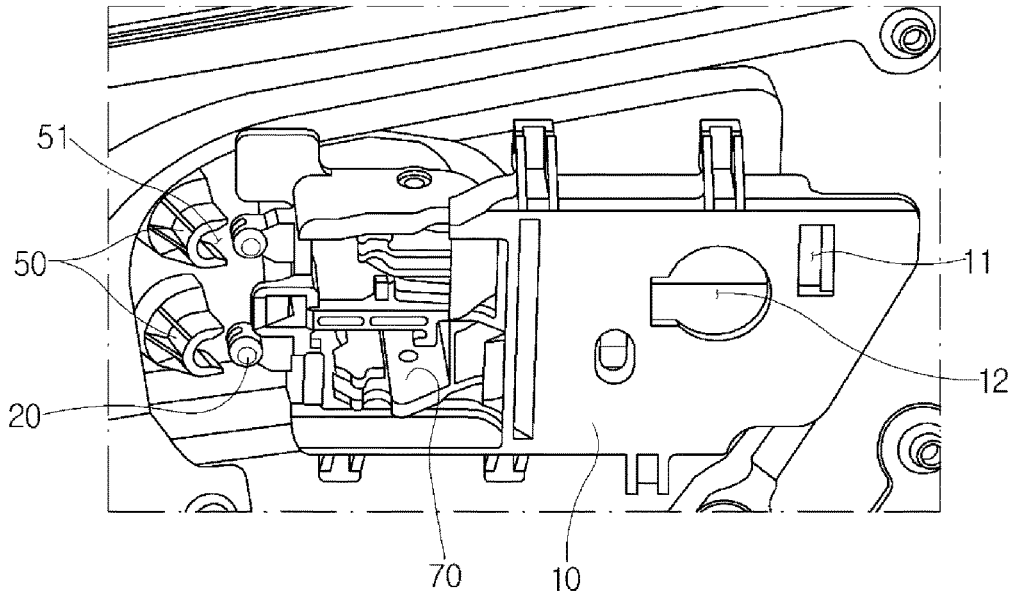
FIG. 3 is an exploded perspective view of an inside door handle assembly for a vehicle according to an embodiment of the present invention.
Figure 4:
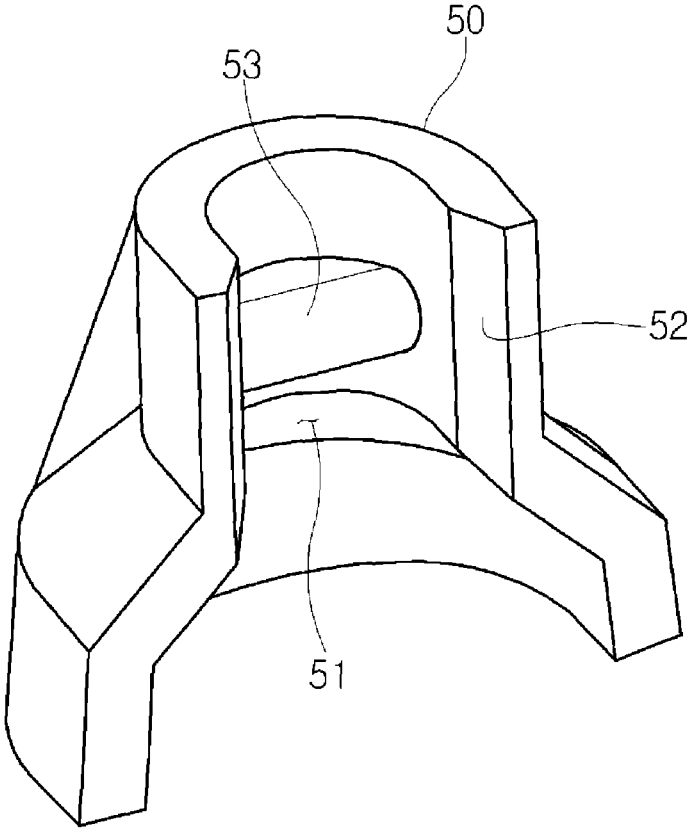
FIG. 4 is a perspective view of a mounting plate illustrated in FIG. 3.
Figure 5:
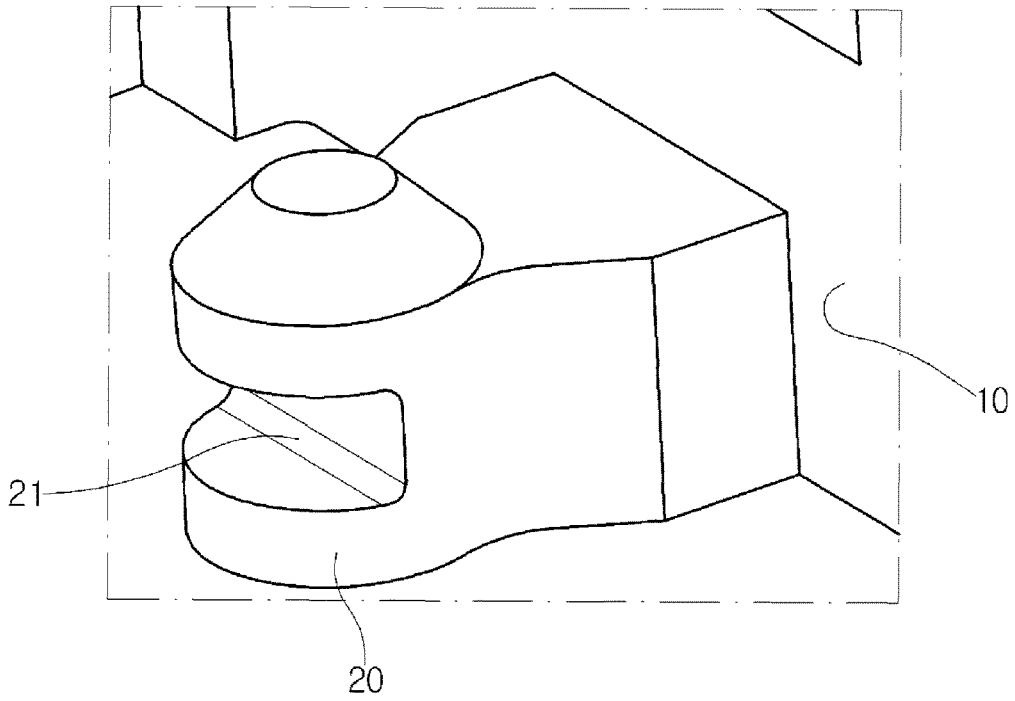
FIG. 5 is a perspective view of a coupling protrusion illustrated in FIG. 3.
Figure 6:
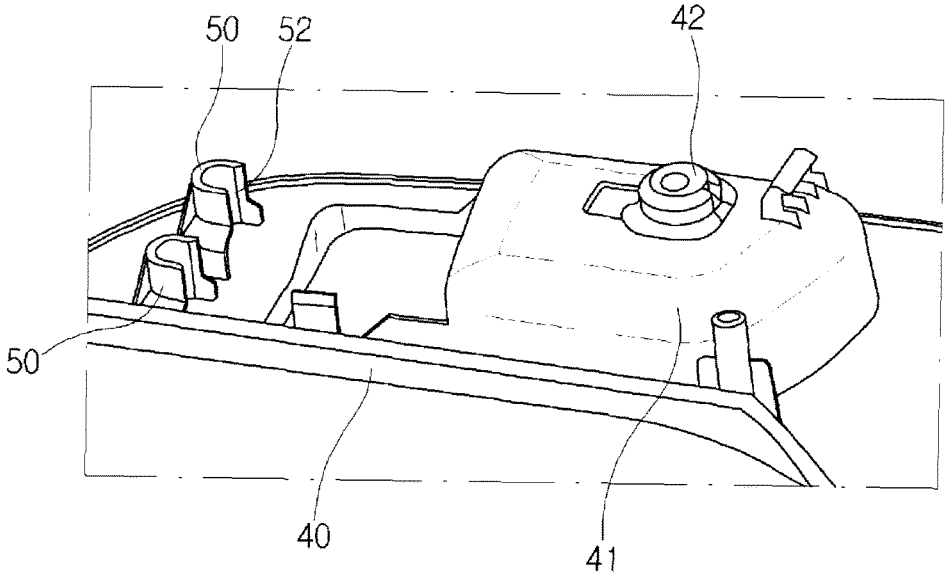
FIG. 6 is a perspective view of a handle housing illustrated in FIG. 3.
Figure 7:
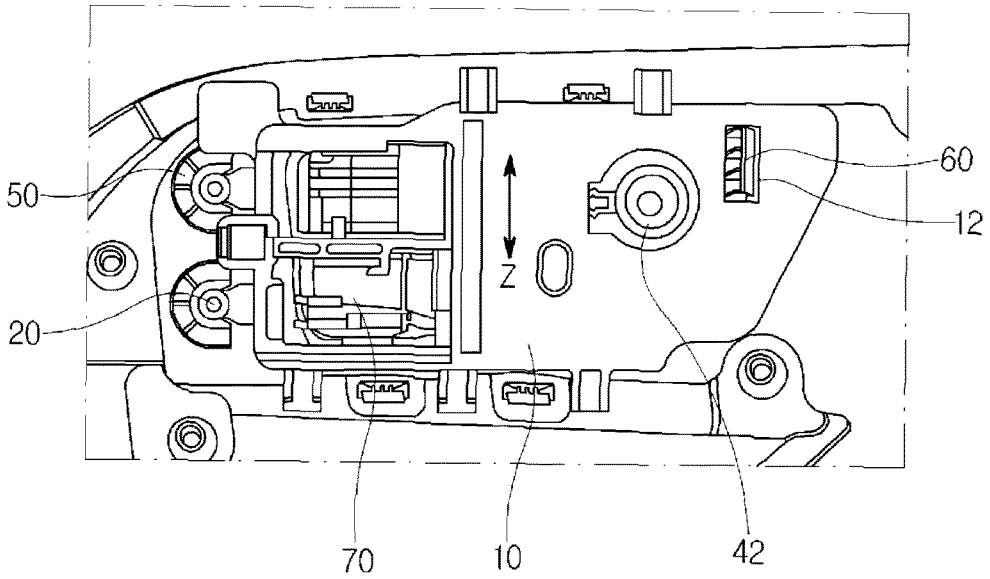
FIG. 7 is a diagram illustrating a state in which the inside door handle assembly illustrated in FIG. 3 is coupled.
Figure 8:
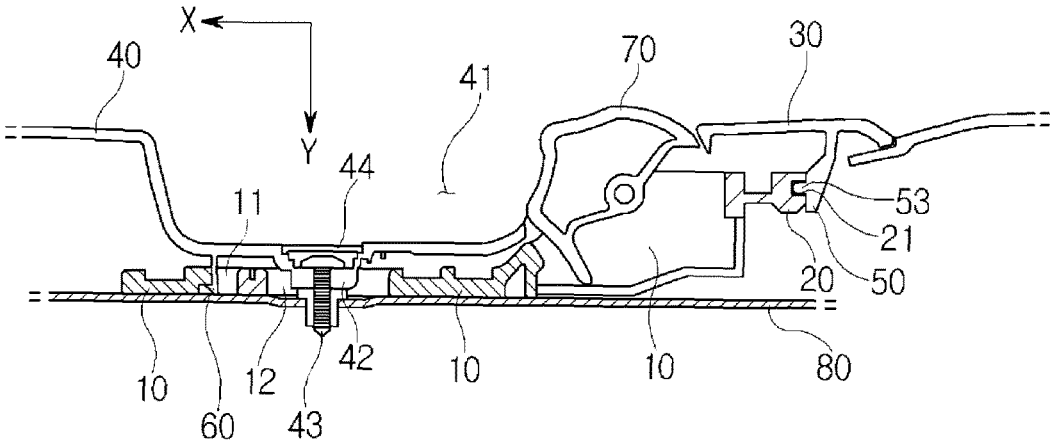
FIG. 8 is a partially cross-sectional view of FIG. 7.

Referring to FIGS. 3 to 8, an inside door handle assembly in a vehicle according to an embodiment of the present invention includes a handle bracket 10, a coupling protrusion 20, a mounting plate 50, and a hook 60. The handle bracket 10 has a hook coupling hole 11 formed therein. The coupling protrusion 20 is formed on the handle bracket 10. The mounting plate 50 has a coupling groove 51 to which the coupling protrusion 20 is coupled. The hook 60 is inserted and coupled to the hook coupling hole 11 of the handle bracket 10.

A door module includes a door trim 30 and a handle housing 40 fixed and coupled to the door trim 30.

The handle housing 40 has a lever housing groove 41 for housing a handle lever (not illustrated). A lever 70 of an inside handle is coupled to the handle bracket 10, and exposed to a lever housing groove 41 of the handle housing 40 such that a user can hold the lever 70 by the hand.

The handle bracket 10 is installed in the space between the handle housing 40 and a door panel 80, that is, the inside of the door. For this structure, a plurality of mounting plates 50 are formed in a door side (door inside) of the handle housing 40, and the hook coupling hole 11 for hook coupling is formed in the handle bracket 10.

The lever 70 of the inside door handle is rotatably installed in the handle bracket 10, and the hook coupling hole 11 and the coupling protrusion 20 are formed at one side of the handle bracket 10.

The mounting plate 50 is formed on the handle housing 40 of the door module so as to protrude to the inside of the door. The mounting plate 50 has the coupling groove 51 for housing the coupling protrusion 20.

The coupling groove 51 of the mounting plate 50 includes an opening 52 formed in a direction X parallel to the door. The coupling protrusion 20 is inserted into the coupling groove 51 of the mounting plate 50 through the opening 52. The opening 52 is formed only at one side of the mounting plate 50 such that the coupling groove 51 has a U-shaped cross-section as a whole. The opening 52 is formed at the front of the door such that the coupling protrusion 20 can be inserted into the coupling groove 51 while being slid from the front to the rear of the door.

Thus, the coupling protrusion 20 is inserted and detached only through the opening 52, and not moved in the vertical direction Z of the door in a state where the coupling protrusion 20 is coupled to the coupling groove 51. The coupling groove 51 has a locking bump 53 formed thereon. Thus, the coupling protrusion 20 is not moved in a direction Y crossing the door in a state where the coupling protrusion 20 is coupled to the coupling groove 51.

The locking bump 53 protrudes from the inner wall of the coupling groove 51, and is formed in the vertical direction of the door. The coupling protrusion 20 has a hinge groove 21 for housing the locking bump 53. When the coupling protrusion 20 is inserted into the coupling groove 51 such that the locking bump 53 is inserted into the hinge groove 21, the handle bracket 10 can be slid and inserted into the mounting plate 50. When the coupling protrusion 20 is inserted into the coupling groove 51 and the locking bump 53, the handle bracket 10 is not moved in the direction crossing the door, due to the locking bump 53. Simultaneously, the mounting plate 50 having a U-shaped cross-section surrounds the coupling protrusion 20 such that the handle bracket 10 is not moved in the vertical direction Z of the door. Since the handle bracket 10 can be detached only through the opening 52 of the mounting plate 50, the handle bracket 10 is reliably supported without being moved in the other directions.

The handle bracket 10 is fixed through hook coupling so as not to be detached through the opening 52, in a state where the handle bracket 10 is inserted into the mounting plate 50.

For this structure, the hook 60 is integrally formed at one side of the handle housing 40 of the door module, and the hook coupling hole 11 is formed at one side of the handle bracket 10, facing the hook 60.

The hook 60 is formed at one side of the handle housing 40 while protruding in the direction Y crossing the door, and the hook coupling hole 11 is formed at one side of the handle bracket 10 facing the hook 60.

In the present embodiment, the hook 60 is formed in the handle housing 40, and the hook coupling hole 11 is formed in the handle bracket 10. However, the hook 60 may be formed in the handle bracket 10, and the hook coupling hole 11 may be formed in the handle housing 40. This structure is also included in the scope of the present invention.

The handle bracket 10 is conveniently fixed and coupled to the handle housing 40 through the locking structure and hook coupling structure between the mounting plate 50 and the coupling protrusion 20. That is, when the handle bracket 10 is pressed into the handle housing 40 in a state where the handle bracket 10 is inclined to insert the coupling protrusion 20 into the coupling groove 51 and the locking bump 53 of the mounting plate 50, the hook 60 is inserted into the hook coupling hole 11, and the handle bracket 10 is conveniently coupled to the handle housing 40.

The handle housing 40 of the door module is piece-coupled to the door panel 80 through the handle bracket 10. The door panel 80 serves as the body of the door, and is installed in the opposite side of the handle housing 40 with the handle bracket 10 provided therebetween.

The handle housing 40 has a coupling boss 42 piece-coupled to the door panel 80. The coupling boss 42 is formed on the inner wall of the lever housing groove 41 of the handle housing 40, and protrudes toward the door panel 80. The head of a coupling piece 43 is seated on the coupling boss 42, and a cap 44 is coupled to cover the head of the coupling piece 43.

The coupling piece 43 is piece-coupled to the door panel 80 through the handle housing 40. For this structure, the handle bracket 10 has a piece through-hole 12 through which the coupling boss 42 is passed.

The handle housing 40 is fixed and coupled to the door panel 50 through a screw, in a state where the handle bracket 10 is fixed and coupled to the handle housing 40 through the locking structure and the hook coupling structure between the mounting plate 50 and the coupling protrusion 20. Thus, the module of the inside door handle can be conveniently and reliably assembled.

According to the embodiment of the present invention, the handle bracket to which the inside handle lever of the door is coupled can be conveniently fixed and coupled to the handle housing through the locking structure and the hook coupling structure instead of screw coupling. Furthermore, as the handle housing is piece-coupled to the door panel, the module of the inside door handle can be conveniently and reliably assembled.

While the present invention has been described with respect to the specific embodiments, it will be apparent to those skilled in the art that various changes and modifications may be made without departing from the spirit and scope of the invention as defined in the following claims.

What is claimed is:

1. An inside door handle assembly for a vehicle, the inside door handle assembly comprising:

a handle bracket in which a lever of the inside door handle is rotatably installed and a hook coupling hole is formed in the handle bracket;

a coupling protrusion protruding from the handle bracket;

a mounting plate protruding from a door module, wherein the mounting plate is provided with a coupling groove into which the coupling protrusion is inserted in a direction parallel to a door, and the mounting plate having a locking bump to support the coupling protrusion and to prevent the coupling protrusion from moving in a direction crossing the door when the coupling protrusion is inserted into the coupling groove; and a hook formed integrally with the door module so as to protrude from the door module, and the hook is inserted and coupled to the hook coupling hole of the handle bracket, wherein the coupling groove of the mounting plate has an opening formed at a front-side of the door such that the handle bracket is not moved in the vertical direction of the door, wherein the coupling protrusion comprises a connecting groove for housing the locking bump and being connected pivotably to the locking bump, and wherein the coupling protrusion is inserted into the coupling groove while being slid from the front-side to a rear-side of the door.

2. The inside door handle assembly according to claim 1, wherein the door module has a coupling boss piece-coupled to a door panel, and the handle bracket has a piece coupling hole formed at one side thereof such that the coupling boss is passed through the piece coupling hole.

3. The inside door handle assembly according to claim 1, wherein the door module comprises:

a door trim; and a handle housing provided with a lever housing groove for housing the handle lever, and fixed and coupled to the door trim.

* * * * *